United States Patent [19]

Sughrue, II et al.

[11] Patent Number: 5,024,750

[45] Date of Patent: Jun. 18, 1991

[54] PROCESS FOR CONVERTING HEAVY HYDROCARBON OIL

[75] Inventors: Edward L. Sughrue, II; Patricia A. Tooley; Brent J. Bertus; Bille S. Grayson, all of Bartlesville, Okla.

[73] Assignee: Phillips Petroleum Company, Bartlesville, Okla.

[21] Appl. No.: 457,411

[22] Filed: Dec. 26, 1989

[51] Int. Cl.[5] ..... C10G 45/00

[52] U.S. Cl. ..... 208/57; 208/49; 208/85; 208/86; 208/87; 208/88; 208/89; 208/95; 208/96; 208/97; 208/67; 208/212; 208/73; 208/216 PP

[58] Field of Search ..... 208/49, 57, 85, 86, 208/87, 88, 89, 95, 96, 97, 67, 212, 73, 216 PP

[56] References Cited

U.S. PATENT DOCUMENTS

| | | | |
|---|---|---|---|
| 2,775,544 | 12/1956 | Corneil et al. | 196/24 |
| 2,846,358 | 8/1958 | Bieber et al. | 196/35 |
| 3,168,459 | 2/1965 | Anderson et al. | 208/57 |
| 3,723,297 | 3/1973 | Gatsis et al. | 208/95 |
| 3,796,653 | 3/1974 | Gatsis | 208/95 |
| 3,859,199 | 1/1975 | Gatsis | 208/97 |
| 4,028,227 | 6/1977 | Gustafson | 208/216 PP |
| 4,085,036 | 4/1978 | Murphy, Jr. et al. | 208/212 |
| 4,176,048 | 11/1979 | Corns et al. | 208/59 |
| 4,191,636 | 3/1980 | Fukui et al. | 208/110 |
| 4,225,421 | 9/1980 | Hensley, Jr. et al. | 208/216 PP |
| 4,306,964 | 12/1981 | Angevine | 208/210 |
| 4,397,733 | 8/1983 | Ellers et al. | 208/96 |
| 4,397,734 | 8/1983 | Ellers et al. | 208/96 |
| 4,404,097 | 9/1983 | Angevine et al. | 208/210 |
| 4,405,441 | 9/1983 | Van Dongen et al. | 208/61 |
| 4,486,295 | 12/1984 | Inooka | 208/96 |
| 4,498,974 | 2/1985 | Billon et al. | 208/96 |
| 4,508,615 | 4/1985 | Oleck et al. | 208/210 |
| 4,511,458 | 4/1985 | Billon et al. | 208/210 |
| 4,619,759 | 10/1986 | Myers et al. | 208/210 |
| 4,752,376 | 6/1988 | Pachano et al. | 208/86 |
| 4,846,961 | 7/1989 | Robinson et al. | 208/210 |

*Primary Examiner*—Anthony McFarlane
*Assistant Examiner*—Nhat Phan
*Attorney, Agent, or Firm*—George E. Bogatie

[57] ABSTRACT

Heavy hydrocarbon oil, containing asphaltene, sulfur and metal contaminants, is hydrotreated in the presence of a hydrotreating catalyst having a small pore diameter in an initial process step to remove sulfur and metal contaminants. Removal of additional metal and sulfur contaminants is then accomplished in a second process step by solvent deasphalting, wherein the size of the pore diameter of the hydrotreating catalyst utilized in the initial hydrotreating step affects the metals rejection in the subsequent solvent deasphalting step. In a third process step the deasphalted oil is catalytically cracked substantially in the absence of added hydrogen to provide lower boiling hydrocarbon products.

18 Claims, 1 Drawing Sheet

PROCESS FOR CONVERTING HEAVY HYDROCARBON OIL

This invention relates to the removal of contaminants from a heavy hydrocarbon containing oil stream. In one aspect it relates to a combination process which includes an intial step of hydrotreating a heavy hydrocarbon containing oil stream in the presence of a catalyst bed which is selective for the removal of sulfur and metal impurities. In another aspect it relates to advantageously coupling further process steps with the initial step of hydrotreating for refining of the heavy oil feed stream.

As refiners increase the proportion of heavier, poorer quality crude oil in the feedstock to be processed, the need grows for processes to treat heavy residual fractions of petroleum, shale oil or similar materials containing asphaltenes. As used herein, asphaltenes are high molecular weight polycyclic components of crude oil which generally boil above 1000° F. and which are insoluble in paraffin naphthas. Asphaltenes hold much of the metal contaminants such as nickel, vanadium, and iron commonly found in the poorer quality crude oil.

The asphaltene content of heavy residue from crude oil distillation, commonly referred to as resid. has long been a problem for economic conversion of the resid into lower boiling more valuable products such motor fuel, distillates and heating oil. In many refineries heavy resid from distillation is pretreated in a hydrotreating process before sending the resid to a catalytic cracking process step. The hydrotreating process step can be effective for removing nearly 80% of the sulfur and metals from heavy hydrocarbon streams. The hydrotreating process step fails, however, to reduce the sulfur and metals content of resid streams obtained in the distillation of poorer quality crude oil to an acceptable level for economic catalytic cracking of the heavy resid. While the hydrotreating process has been upgraded with advances in catalyst technology, the crude oil quality has deteriorated faster than the improvements in the catalyst can compensate for the deterioration.

Accordingly, it is an object of this invention to obtain lower boiling hydrocarbon products from heavy hydrocarbon oil streams containing asphaltenes.

It is another object of this invention to provide an economical commercial method of upgrading heavy distillation resid streams.

It is a further object of this invention to provide a heavy oil feedstock of lower metal content for catalytic cracking operations.

It is a further object of this invention to improve the selectivity operation and to lower the rate of catalyst addition to a cracking unit for catalytic cracking of heavy hydrocarbon oil.

It is a further object of this invention to reduce the $SO_x$ emission to the atmosphere from catalytically cracking a heavy hydrocarbon oil stream.

It is a still further object of this invention to provide an integrated process including hydrotreating, optionally followed by heat soaking, then followed by solvent deasphalting, solvent separation and finally catalytic cracking to produce the desired lighter hydrocarbon products from heavy hydrocarbon oil.

SUMMARY OF THE INVENTION

In accordance with the present invention, a process for treating a heavy hydrocarbon containing feed stream, which contains asphaltenes and impurity compounds of sulfur and metal, comprises the steps of:

(a) contacting the heavy hydrocarbon containing feed stream with a hydrogen-containing reactant gas in the presence of a hydrotreating catalyst having a pore diameter in a range of from about 40 to about 80 angstroms at condition sufficient for removing a portion of sulfur and metal impurities from the feed stream and without substantially cracking the feed stream so as to provide an effluent having a reduced sulfur content;

(b) contacting the reduced sulfur effluent with a solvent so as to form a mixture comprising at least two phases wherein a first phase comprises an extract which is relatively lean in asphaltenes and metal content relative to the reduced sulfur effluent and a second phase comprises a raffinate which is relatively rich in asphaltenes and metal content relative to the reduced sulfur effluent;

(c) separating the first phase and the second phase, and thereafter removing the solvent from the first phase so as to provide an effluent stream essentially free of solvent;

(d) catalytically cracking the solvent free effluent stream, in the presence of a catalytic cracking catalyst and essentially in the absence of added hydrogen containing gas so as to produce lower molecular weight hydrocarbon products.

In a preferred embodiment of this invention, we have invented a combination process for the refining of, for example atmospheric distillation resid streams, which advantageously couples several individual process steps. In the combination process a relatively low average pore diameter hydrotreating catalyst, utilized in the initial step for hydrotreating, unexpectedly improves contaminant metal removal in a following solvent deasphalting step. Further the combination process includes solvent removal following the solvent deasphalting step, catalytic cracking following the solvent removal step and optionally includes a relatively low temperature heat soaking step prior to the solvent deasphalting step.

In the combination process, following the initial step for hydrotreating using a relatively small pore diameter hydrotreating catalyst, the hydrotreated feed stock optionally may be subjected to heat soaking for about 10 to 200 hours, preferably at about 80 to 120 hours, at a temperature of about 500°-700° F., preferable about 570°-630° F. and at atmospheric pressure. The asphaltenes are then selectively removed by a solvent deasphalting process step, wherein an appropriate solvent, in a weight-ratio of about 1-10 parts solvent per part of feed, is employed to dissolve the non-asphalteneic constituents, leaving an asphaltic precipitate which can easily be separated from the resulting mixture. Preferably paraffin naphthas, starting with n-pentene and increasing to paraffins having as many as 20 carbon atoms per molecule, can be used as the solvent in the deasphalting process step, which also includes removal and recycle of the solvent from the deasphalted oil. Catalytic cracking follows the deasphalting step to provide relatively light hydrocarbon products, and the removed asphalt product can be utilized, for example, as a component for blending asphalt pavement.

BRIEF DESCRIPTION OF THE THE DRAWINGS

FIG. 1 is a schematic flow diagram illustrating the process steps of the invention and the products produced therefrom.

DETAILED DESCRIPTION OF THE PREFERRED EMBODIMENTS

Figure 1:
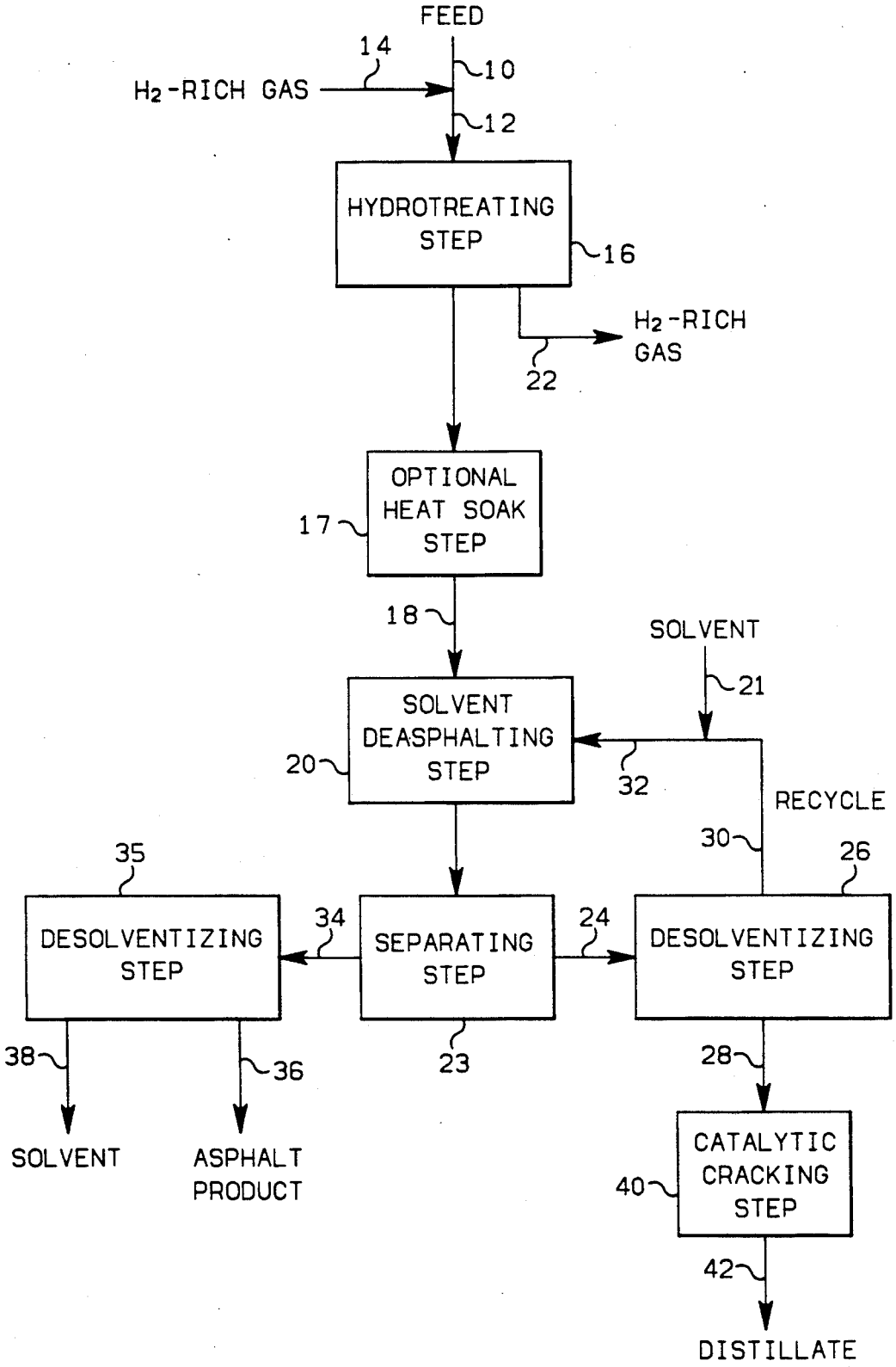

Any processable hydrocarbon-containing feed stream, which is substantially liquid at the hydrotreating conditions and contains compounds of metals, in particular nickel and/or vanadium, and sulfur as impurities, can be employed in the combination process of this invention. Generally these feed streams also contain coke precursors, measured as Ramsbottom carbon (ASTM Method D524), and nitrogen compounds as impurities. Suitable hydrocarbon containing feed streams include crude oil and heavy fractions thereof, heavy oil extracts, liquid coal pyrolyzates, liquid products from coal liquefication, liquid extracts and liquid pyrolyzates from tar sands, shale oil and heavy shale oil fractions. The process of this invention is particularly suited for treating heavy crudes and heavy petroleum residua, which generally hav an initial boiling point at atmoshperic pressure in excess of about 400° F. and preferably in excess of about 600° F. These heavy oils feeds generally contain at least about 5 ppmw (parts per million by weight) vanadium, preferably 5–1000 ppmw vanadium; at least about 3 ppmw Ni and preferably about 3–500 ppmw Ni; at least about 0.5 weight percent sulfur, preferably about 0.5 to 5 weight percent sulfur; about 0.2–.01 weight percent nitrogen; and about 1–20 weight percent Ramsbottom carbon residue (as determined by ASTM D524). The API gravity (measured at 60° F) of these feeds generally about 5–30 and preferably about 8–25.

HYDROTREATING PROCESS STEP

The hydrotreating process step of this invention can be carried out in any apparatus whereby an intimate contact of the catalyst with the hydrocarbon-containing feed stream and a free hydrogen containing gas is achieved, under such conditions as to produce a hydrocarbon-containing effluent stream having reduced levels of metals (in particular nickel and vanadium) and reduced levels of sulfur, and a hydrogen-rich effluent stream. Generally, a lower level of nitrogen and Ramsbottom carbon residue and higher API gravity are also attained in this hydrotreating process.

The hydrotreating process step of this invention can be carried out as a batch process or, preferably, as a continuous downflow or upflow process, more preferably in a tubular reactor containing one or more fixed catalyst beds, or in a plurality of fixed bed reactors in parallel or in series. The hydrocarbon containing product stream from the hydrotreating step can be distilled, e.g. in a fractional distillation unit, so as to remove lower boiling fraction from the product stream.

Any suitable reaction time between the catalyst, the hydrocarbon-containing feed stream, and hydrogen-containing gas can be utilized. In general the reaction time will be in the range of from about 0.05 hours to about 10 hours, preferably from about 0.4 hours to about 5 hours. In a continuous fixed bed operations, this generally requires a liquid hourly space velocity (LHSV) in the range of from about 0.10 to about 10 volume (V) feed per hour per volume of catalyst, preferably from about 0.2 to about 2.5 V/Hr./V.

In one embodiment the hydrotreating process employing a fixed bed catalyst of the present invention can be carried out at any suitable temperature. The reaction temperature will generally be in the range from about 392° F. (200° C.) to about 932° F. (500° C.) and will preferably be in the range of about 572° F. (300° C.) to about 842° F. (450° C.) to minimize cracking. Higher temperatures do improve the removal of impurities, but temperatures which will have adverse effects on the hydrocarbon containing feed stream, such as excessive coking, will usually be avoided. Also, economic considerations will usually be taken into account in selecting the temperature.

Any suitable pressure may be utilized in the hydrotreating process. The reaction pressure will generally be in the range from about atmospheric pressure to up to 5000 psig pressure. Preferably, the pressure will be in the range of from about 100 about 2500 psig. Higher pressures tend to reduce coke formation, but operating at high pressure may be undesirable for safety and economic reasons.

Any suitable quantity of free hydrogen can be added to the hydrotreating process. The quantity of hydrogen used to contact the hydrocarbon containing feed stream will generally be in the range of from about 100 to about 10,000 scf hydrogen per barrel of hydrocarbon containing feed, and will more preferably be in the range of from about 1,000 to about 7,000 scf of hydrogen per barrel of the hydrocarbon containing feed stream. Either pure hydrogen or a free hydrogen containing gaseous mixture e.g. hydrogen and methane, hydrogen and carbon monoxide, or hydrogen and nitrogen can be used.

In accordance with this invention, the catalyst employed in the initial step for hydrotreating a substantially liquid heavy hydrocarbon-containing feed stream, which also contains sulfur and metal components as previously described, comprises a typical small pore diameter hydrotreating catalyst having an average pore diameter in the range of from about 40 to about 100 angstroms, preferably in a range of from about 40 to about 80 angstroms. Generally, these hydrotreating catalysts comprise alumina, optionally combined with titania, silica, alumina phosphate, and other porous inorganic oxides or the like, as support materials, and compounds of at least one metal selected from the groups consisting of Group VI and Group VIII metals, preferably molybdenum, tungsten, iron, cobalt, nickel and copper as promoters. An example of a preferred catalyst is a material described in Example II. This catalyst is an alumina based hydrotreating catalyst comprising 2.4 weight-percent Co, and 6.7 weight-percent Mo, having a BET/$N_2$ surface area of 290 $m^2/g$, pore volume (by intrusion porosimetry) of 0.47 cc/g and an average pore diameter of 65 angstroms, as determined from the formula:

$$\text{avg. dia.} = [4 \times \text{pore vol.} \times 10^4]/\text{surface area}$$

where units are:
avg. dia. = angstroms
pore vol. = cubic centimeters/gram
surface area = square meters/gram In the hydrotreating step of this invention, the small pore diameter catalyst may be utilized in a fixed bed as the sole hydrotreating catalyst, as described above. Further, however, in accordance with this invention, the small pore diameter catalyst may be utilized in combination with a large pore diameter catalyst, such as a catalyst having an average pore diameter in a range of from about 100 to about 500 angstroms. Preferably, a mixed catalyst bed system may be utilized wherein a layer of large pore diameter catalyst is placed above a layer of small pore diameter catalyst for catalytically treating a feed material. Alternatively, a layer of large pore diameter catalyst is placed below a layer of small pore diameter catalyst.

Still further, in accordance with this invention, the hydrotreating step may employ a moving catalyst bed, an ebulated catalyst bed or a slurry mode in place of a fixed catalyst bed to effect hydrotreating of the feed material.

SOLVENT DEASPHALTING PROCESS STEP

The liquid product oil effluent from the initial step of hydrotreating can be treated in a deasphalting process step. Such a deasphalting step can include solvent extraction of the oil from the asphaltenes by mixing the effluent from the hydrotreating step with, for example n-pentane preferably in a solvent to oil ratio of from about 5/1 to about 20/1. The deasphalting extraction process step of this invention can be carried out in any suitable vessel. Preferably the hydrotreated oil is transferred to a deasphalting zone which comprises a countercurrent mixing tower in which the oil is contacted with a solvent. An extract phase is formed which is relatively lean in asphaltene and metal contaminants, and a raffinate phase in the form of an asphaltic precipitate is formed which is relatively rich in metal contaminants and asphaltenes. The extract and raffinate phases must be separated from one another by any suitable means.

The extract phase of the deasphalting process step, comprising a mixture of deasphalted oil and solvent is passed to a separation zone for desolventizing the extract phase, in which the mixture is separated into a deasphalted oil fraction relatively low in asphaltic and metal compounds, and a solvent fraction which is recycled to the deasphalting step.

The raffinate phase, usually comprising a semi-molten asphaltene fraction containing a small amount of solvent, is withdrawn and passed to a separation zone, which can be flash separation, wherein the mixture is separated into an asphalt product stream and a solvent stream.

The operating conditions for the solvent deasphalting process step are dependent upon the type of solvent, solvent to oil ratio and the characteristics of the feedstock supplied to the deasphalting step. These variables are generally known by those skilled in the art.

The preferred solvents employed in this invention are those whose critical parameters render them suitable for conventional supercritical extraction operations when they are under supercritical conditions, i.e. at or above the critical temperature and/or pressure of the solvent(s). As used herein, the critical temperature of a solvent, is the temperature above which it cannot be liquefied or condensed via pressure changes. The solvents critical pressure is the pressure required to maintain the liquid state at the critical temperature.

Generally, solvents useful in the extraction operation of this invention are hydrocarbon compounds containing from about 3 to about 20 carbon atoms per molecule. Typical solvents, which are substantially liquid at the extraction conditions, include saturated cyclic or acyclic hydrocarbons containing from about 3 to about 8 carbon atoms per molecule, and the like, and mixtures thereof. Preferred solvents include $C_3$ to $C_7$ paraffins and mixtures thereof. Highly preferred solvents are propane, n-butane, isobutane, n-pentane, branched hexanes, n-heptane, and branched heptanes. Other suitable solvents include carbon dioxide and sulfur dioxide.

Various considerations, such as economics and apparatus limitations will have bearing on the parameters under which extraction takes place. Furthermore routine experimentation by the skilled artisan will yield optimum parameters for a given situation. With this in mind, the following tabulation should be read as merely suggestive, and not limiting, in carrying out processes based on the instant invention. The following extraction variables are suggested:

| Variable | Broad Range | Preferred Range |
|---|---|---|
| Temperature, °F. | 100–800 | 300–600 |
| Solvent/Oil Wt. ratio | 1:1 to 100:1 | 5:1 to 10:1 |
| Pressure, atmos. | 1 to 136 | 1 to 54 |
| Residence time, min. | 0.5 to 60 | 1 to 20 |

Commercially, solvent can be recovered in an energy efficient manner by reducing the solubility of the extract oil in the supercritical solvent. This is done by decreasing the pressure and/or increasing the temperature of the oil-solvent mixture.

CATALYTIC CRACKING PROCESS STEP

In petroleum processing operations such as catalytic cracking in the presence of metallic contaminants in the feedstock, and in the absence of added reactant hydrogen, rapid catalyst contamination by metals causes an undesirable increase in hydrogen and coke make, loss in gasoline yield, loss in conversion activity, and decrease in catalyst life.

According to this invention, the catalytic cracking process step treats a deasphalted and desolventized oil fraction relatively low in metal compounds typically in the absence of added reactant hydrogen gas. The catalytic cracking process may be carried out in any conventional manner known by those skilled in the art so as to provide hydrocarbon products of lower molecular weight.

Any suitable reactor can be used for the catalytic cracking process step of this invention. Generally a fluidized-bed catalytic cracking (FCC) reactor, preferably containing one or two or more risers, or a moving bed catalytic cracking reactor, e.g. a Thermofor catalytic cracker, is employed. Presently preferred is a FCC riser cracking unit containing a cracking catalyst. Especially preferred cracking catalysts are those containing a zeolite imbedded in a suitable matrix, such as alumina, silica, silica-aluminia, aluminum phosphate, and the like. Examples of such FCC cracking units are described in U.S. Pat. Nos. 4,377,470 and 4,424,116, the disclosures of which are herein incorporated by reference.

The cracking catalyst composition that has been used in the cracking process (commonly called "spent" catalyst) contains deposits of coke and metals or compounds of metals, in particular nickel and vanadium compounds. The spent catalyst is generally removed from the cracking zone and then separated from formed gases and liquid products by any conventional separation means (e.g. a cyclone separator), as is described in the above cited patents and also in a text entitled "Petroleum Refining" by James H. Gary and Glenn E. Handwerk, Marcel Dekker, Inc., 1975, the disclosure of which is herein incorporated by reference.

Adhered or absorbed liquid oil is generally stripped from the spent catalyst by flowing steam, preferably having a temperature of about 700° to 1,500° F. The steam stripped catalyst is generally heated in a free oxygen-containing gas stream in the regeneration unit of the cracking reactor, as is shown in the above-cited references, so as to produce a regenerated catalyst. Generally, air is used as the free oxygen containing gas; and the temperature of the catalyst during regeneration with air preferably is about 1100°-1400° F. Substantially all coke deposits are burned off and metal deposits, in particular vanadium compounds, are at least partially converted to metal oxides during regeneration. Enough fresh, unused catalyst is generally added to the regenerated cracking catalyst so as to provide a so-called equilibrium catalyst of desirably high cracking activity. At least a portion of the regenerated catalyst, preferably equilibrium catalyst, is generally recycled to the cracking reactor. Preferably the recycled regenerated catalyst, preferably equilibrium catalyst, is transported by means of a suitable lift gas stream (e.g. steam) to the cracking reactor and introduced to the cracking zone, with or without the lift gas.

Specific operating conditions of the cracking operation depend greatly on the type of feed, the type and dimensions of the cracking reactor and the oil feed rate. Examples of operating conditions are described in the above-cited references and in many other publications. In a FCC operation, generally the weight ratio of catalyst composition to oil feed (i.e. hydrocarbon-containing feed) ranges from about 2:1 to about 10:1, the contact time between oil feed and catalyst is in the range of about 0.2 to about 3 seconds, and the cracking temperature is in the range of from about 800° to about 1200° F. Generally steam is added with the oil feed to the FCC reactor so as to aid in the dispersion of the oil as droplets. Generally the weight ratio of steam to oil feed is in the range of from about 0.01:1 to about 0.5:1. Hydrogen gas can also be added to the cracking reactor; but presently hydrogen gas addition is not a preferred feature of this invention. Thus, added hydrogen gas should be substantially absent from the cracking zone. The separation of the cracked liquid products into various gaseous and liquid product fractions can be carried out by any conventional separation means, generally by fractional distillation. The most desirable product fraction is gasoline (ASTM boiling range: about 180°-400° F). Non limiting examples of such separation schemes are illustrated in the text "Petroleum Refining", cited above.

COMBINATION PROCESS

The combination process is illustrated in detail by reference to FIG. 1, which shows the flow relationship of reactions and products. The asphaltene-containing oil feedstock from line 10 is passed through line 12 where it is mixed with hydrogen rich gas supplied through line 14. The entire feed mixture, which can be preheated to the proper reactor inlet temperature, is passed through a hydrotreating step 16 in a reactor containing a solid hydrotreating catalyst, for removal of sulfur and metal impurities.

After contacting in the hydrotreating step, the effluent oil therefrom, consisting of hydrotreated oil, optionally passes through a heat soaking step 17 and then passes through line 18 to a solvent deasphalting step 20. The hydrogenation reaction compounds such as hydrogen sulfide, ammonia, etc. formed in the hydrotreating step 16 leave the hydrotreating reactor in the hydrogen-rich gas line 22. If desired, the effluent hydrogen-rich gas in line 22 may be cooled and passed to a separating step, not illustrated, to separate the hydrogen-sulfide/-hydrogen, and the hydrogen may be recycled to the hydrotreating step. Optionally, low boiling fractions can be removed from the hydrotreated oil by flashing or distillation.

The hydrotreated oil in line 18, having a reduced content of sulfur and metals relative to the feed stream flowing in line 12, is passed by way of line 18 into the deasphalting step 20. In the deasphalting step 20, a solvent extraction process is employed wherein large molecular weight asphaltene contaminants are precipitated, while lighter hydrocarbons are solvent extracted. Solvent is introduced into the deasphalting step 20 via line 21, and the solvent and hydrotreated oil are contacted such that two phases, i.e. extract and raffinate, are formed.

The extract phase comprising a deasphalted-oil/solvent mixture, which can be at ambient temperature and atmospheric pressure, is removed from the separating step 23 via line 24 and is then passed to a desolventizing step 26 in which the mixture is separated into a solvent-free oil fraction relatively low in asphaltic and metal compounds, and a solvent. On exiting step 26 through line 28, the solvent-free oil is passed through a catalytic cracking step 40 where a plurality of product streams, collectively represented by line 42, are withdrawn through line 42. The solvent fraction which exits step 26 through line 30 is combined with fresh solvent provided through line 21 and recycled to step 20 through line 32.

The asphaltene fraction removed from separating step 23 can be fed to a separation step 35, e.g. a flash separation, wherein the mixture is separated into an asphalt product stream exiting through line 36, and a solvent stream exiting through line 38.

The following examples are presented to further illustrate the invention and are not to be considered unduly limiting the scope of this invention.

EXAMPLE 1

In this example, the automated experimental setup for investigating the hydrotreating of heavy oils in accordance with the present invention is described.

Oil was pumped downward through an induction tube into a trickle bed reactor, 28.5 inches long and 0.75 inches in diameter. The oil pump used was a reciprocating pump with a diaphragm-sealed head. The oil induction tube extended into a catalyst bed (the top of the bed was located about 3.5 inches below the reactor top) comprising a volume of catalyst of about 12 cubic inches.

The heavy oil feed was a refinery atmospheric distillation residual. The feed contained about 1.5 weight-% sulfur, 20.5 ppmw (parts by weight per million parts by weight feed) nickel, 44.4 ppmw vanadium, and had a viscosity of 34.41 saybolt.

Hydrogen was introduced into the reactor through a tube that concentrically surrounded the oil induction tube but extended only to the reactor top. The reactor was heated with a 3- zone furnace. The reactor temperature was measured in the catalyst bed at three different locations by three separate thermocouples embedded in axial thermocouple wells (0.25 inch outer diameter). The liquid product oil was generally sampled every day for analysis. The hydrogen gas was vented. Vanadium, nickel, and sulfur contents were determined by plasma emission analysis.

EXAMPLE II

This example illustrates comparative data for the removal of nickel and vanadium metal contaminants and sulfur from a heavy oil feed by hydrotreating in the presence of a relatively large pore diameter catalyst, A, and a relatively small pore diameter catalyst, B. Pertinent hydrotreating process conditions were selected to provide the same vanadium content in the effluent product for both the small pore and large pore catalyst.

The catalyst utilized in this example are alumina based catalyst characterized by:

| | A | B |
|---|---|---|
| percent Mo: | 0.3 | 6.7 |
| percent Co: | 0 | 2.4 |
| surface area, $m^2$/gram: | 144 | 290 |
| pore volume, cc/gram: | 1.0 | 0.47 |
| average pore dia., angstroms: | 277 | 65 |

Pertinent test conditions and test results are summarized in Table I.

TABLE I

METAL REJECTION IN HYDROTREATING PROCESS

| | | | | Content | | | % removed | | |
|---|---|---|---|---|---|---|---|---|---|
| Run* | Catalyst | Temp. °F. | Flow Rate (LHSV) | Ni ppmw | V ppmw | S wt % | Ni ppmw | V ppmw | S wt % |
| 1 | A | 720 | 0.45 | 10.4 | 13.2 | 1.17 | 49 | 70 | 20 |
| 2 | B | 690 | 0.30 | 7.2 | 13.3 | 0.22 | 65 | 70 | 85 |

*$H_2$ pressure = 2000 psig
$H_2$ addition rate = 5000 SCF/bbl

Data in Table I shows that at the specific hydrotreating conditions of Runs 1 and 2, the removal of vanadium from the feed stream in a hydrotreating process was essentially the same for both the large pore diameter catalyst A and small pore diameter catalyst B.

EXAMPLE III

This example illustrates the experimental procedure for investigating the solvent extraction of heavy oils in accordance with the present invention.

A heavy oil feed was preheated, generally to about 250°-330° F., by means of a steam traced feed tank and electric heating tapes wrapped around stainless steel feed lines (inner diameter, about ¼ inch). The entire n-pentane solvent stream was preheated in a split-type tubular furnace from Mellen Company, Pennacock, N.H.; Series 1, operating at a temperature of about 400°-500° F. The solvent and oil streams were then pumped by two Whitney Corp., Highland Heights, OH, positive displacement diaphragm-sealed pumps through the furnace and into a static mixer, which was about 3 inches long and had an inner diameter of about ⅜ inch.

The solvent-oil mixture was charged to a vertical stainless steel extractor, without packing or baffles, which consisted of a bottom pie section having a length of about 11 inches and an inner diameter of about 1.69 inches, a 2 inch long reducer section and an upper pipe section of 27 inch length and 1.34 inch inner diameter. The charge point of the oil-solvent feed mixture was about 2 inches above the reducer.

The entire extractor was wrapped with electrical heating tape and was well insulated. The temperature in the extractor was measured in 4 locations by thermocouples inserted through thermocouple fittings which extended into the center of the extraction column. The temperature at the top of the extractor was considered the most important temperature measurement and is considered to be the extraction temperature.

The pressure in the extractor was regulated by a pressure controller which sensed the pressure in the exit line and manipulated a motor valve operatively connected in the exit line in response to the sensed pressure. For simplicity in these examples, the depressurized extract was condensed in a water-chilled condenser and passed into a collector flask. Samples of the extract were distilled in a nitrogen atmosphere so as to separate the solvent from the extract oil, and the oil was then analyzed. Vanadium, nickel, and sulfur content were determined by plasma emission analysis.

EXAMPLE IV

This example illustrates solvent extraction of heavy oil which was first hydrotreated in accordance with Example II. The oil contained contaminants of nickel, vanadium and sulfur as indicated in columns 5, 6 and 7 of Table I, and was solvent extracted according to the procedure outlined in Example III. The extract oil was separated from the solvent at atmospheric pressure, and the extract oil was then analyzed.

Pertinent test conditions and test results are summarized in Table II, wherein the catalyst indicated in column 2 of Table I refers to the catalyst used in the hydrotreating process illustrated in Example II.

TABLE II

EFFECT OF CATALYST PORE DIAMETER ON METALS REJECTION

| | | | | effluent content | | | % removed** | |
|---|---|---|---|---|---|---|---|---|
| Run | Feed | Temp °F. | Pres. psia | Ni ppmw | V ppmw | S wt % | Ni ppmw | V ppmw |
| 3 | *Run 1 | 400 | 1060 | 2.0 | 2.2 | 1.4 | 81 | 83 |
| 4 | *Run 2 | 388 | 1265 | 0.04 | 0.33 | 0.15 | 99.4 | 99.8 |

*effluent
**based on hydrotreated feeds from runs 1 and 2, respectively.

The data in Table II clearly show that the removal of the metals of nickel and vanadium in the solvent extraction process was highest for the feed which was pretreatd using a relatively small pore diameter catalyst, i.e. Catalyst B in a hydrotreating process.

Additional tests were run using a mixed catalyst bed, wherein a layer of relatively large pore diameter catalyst, similar to catalyst A described in Example II, was placed above a layer of small pore diameter catalyst, which is also described in Example II. These additional tests showed substantially the same results as those illustrated in Table II, wherein only a small pore diameter catalyst was used.

Therefore, a catalytic cracking feedstock, pretreated in accordance with the combination of process steps according to this invention, provides the benefits of catalytically cracking a low metal content hydrocarbon oil in the substantial absence of added reactant hydrogen. These benefits include increased catalyst life, improved conversion, improved selectively, etc.

EXAMPLE V

The following tests were conducted to learn the effect of visbreaking in a heat soaking step, (after the hydrotreating step) on a subsequent solvent deasphalting step. In this test a charge stock containing large quantities of asphaltene, e.g. a resid from vacuum distillation, was hydrotreated essentially in accordance with the procedure set forth in Example II. The hydrotreated resid, which contained metal contaminants of 10.4 ppmw vanadium and 7.3 ppmw nickel, was subjected to a series of solvent deasphalting (i.e. selective solvent extraction) steps wherein the deasphalting was conducted at various solvent-to-oil ratios both with and without an intermediate heat soaking step. Otherwise the deasphalting procedure was essentially as set forth in Example IV.

Pertinent test conditions for heating the hydrotreated resid for heat soaking include:
Pressure: atmospheric
Temp: 600° F.
Time: 100 Hrs.

Test results are summarized in Table III.

TABLE III

EFFECT OF VISBREAKING ON METAL REJECTION

| Run | Process | S/O Ratio | Product V ppmw | Product Ni ppmw | Product Metal ppmw |
|---|---|---|---|---|---|
| 5 | HT-EXT | 5:1 | 3.5 | 2.6 | 6.1 |
| 6 | HT-HS-EXT | 5:1 | 1.5 | 0.9 | 2.4 |
| 7 | HT-EXT | 3:1 | 5.0 | 3.9 | 8.9 |
| 8 | HT-HS-EXT | 3:1 | 2.7 | 1.6 | 4.3 |
| 9 | HT-EXT | 2:1 | 3.9 | 3.4 | 7.3 |
| 10 | HT-HS-EXT | 2:1 | 3.5 | 2.2 | 5.7 |

where: HT = Hydrotreated
HS = Heat Soaked
EXT = Selective Solvent Extraction

Data in Table III shows that heat soaking the hydrotreated resid prior to solvent extraction can be effective for reducing the metal content at a reduced solvent to oil ratio in the solvent extraction step, thereby further reducing contaminant levels and enhancing the benefits of providing a low metals content oil feed for catalytic cracking.

While the invention has been described in terms of the presently preferred embodiment, reasonable variations and modifications are possible by those skilled in the art. Such modifications and variations are within the scope of the described invention and the appended claims.

That which is claimed:

1. A process for treating a heavy hydrocarbon containing feed stream, which contains asphaltenes and impurity compounds of sulfur and metals, said process comprising the following steps performed in the sequence set forth below:

(a) contacting said heavy hydrocarbon feed stream with a hydrogen-containing reactant gas in the presence of an alumina supported hydrotreating catalyst including compounds selected from Group VI and VII metals as promoters and having an average pore diameter in a range of about 40 to about 80 angstroms at conditions sufficient for removing a substantial portion of sulfur and metal impurities from said feed stream so as to provide an effluent having a reduced sulfur content;

(b) contacting said reduced sulfur effluent with a solvent so as to form a mixture comprising at least two phases, wherein a first phase comprises an extract which is relatively lean in asphaltenes and metal content relative to said reduced sulfur effluent, and a second phase comprises a raffinate which is relatively rich in asphaltenes and metal content relative to said reduced sulfur effluent;

(c) separating said first phase and said second phase, and thereafter removing the solvent from said first phase so as to provide an effluent stream essentially free of solvent; and (d) catalytically cracking said solvent free effluent stream, in the presence of a catalytic cracking catalyst and essentially in the absence of added hydrogen containing reactant gas so as to produce lower molecular weight hydrocarbon products.

2. A process in accordance with claim 1 wherein said heavy hydrocarbon containing feed stream comprises a heavy distillation residual fraction.

3. A process in accordance with claim 1 wherein said compounds of metal contaminants in said feed stream comprise compounds of at least one metal selected from the group consisting of nickel and vanadium and iron.

4. A process in accordance with claim 1, wherein said feed stream comprises about 3–500 ppmw nickel and about 5–1000 ppmw vanadium.

5. A process in accordance with claim 1, wherein said feed stream comprises about 0.5–5.0 weight-percent sulfur.

6. A process in accordance with claim 1, wherein step (b) additionally comprises forming an asphaltic precipitate from the resulting dissolved hydrocarbon mixture.

7. A process in accordance with claim 6, wherein said solvent comprises at least one member selected from the group consisting of propane, n-butane, isobutane, n-pentane, branched hexanes, n-heptane, branched heptanes, carbon dioxide and sulfur dioxide.

8. A process in accordance with claim 1, wherein operating conditions in step (a) comprise a liquid hourly space velocity of from about 0.2 to 2.5 volumes of hydrocarbon feed per hour per volume of catalyst, a temperature within a range of about 392° F. (200° C.) to about 932° F. (500° C.), and a pressure within a range of about 100 to about 5000 psig.

9. A multiple step process for hydrocarbon oil conversion including hydrotreating a substantially liquid heavy hydrocabon containing feed stream which also contains asphaltenes and impurity compounds of sulfur and metals, solvent deasphalting the hydrotreated stream, desolventizing the deasphalted stream, and catalytically cracking the desolventized stream so as to produce lower molecular weight hydrocarbon products from said substantially liquid heavy hydrocarbon stream, said process comprising:

(a) contacting a heavy hydrocarbon oil feed stream with a hydrogen-containing reactant gas in the presence of hydrotreating catalyst having an average pore diameter in a range of from about 40 to about 80 angstroms at conditions sufficient for removing a portion of sulfur and metal impurities from said feed stream and without substantially cracking said feed stream so as to provide a desulfurized effluent;

(b) removing asphaltenes from said desulfurized effluent by contacting said desulfurized effluent with a solvent to form an asphaltic precipitate from the resulting dissolved hydrocarbon mixture, and forming a deasphalted stream comprising a mixture of deasphalted-oil and solvent;

(c) separating solvent from said deasphalted-oil and providing a solvent-free oil stream;

(d) catalytically cracking said solvent-free oil stream, in the presence of a catalytic cracking catalyst and essentially in the absence of added hydrogen containing reactant gas so as to produce lower molecular weight hydrocarbon products.

10. A process for treating a heavy hydrocarbon containing feed stream, which contains asphaltenes and impurity compounds of sulfur and metals, said process comprising:

(a) contacting said heavy hydrocarbon feed stream with a hydrogen-containing reactant gas in the presence of a hydrotreating catalyst having an average a pore diameter in a range of from about 40 to about 80 angstroms at conditions sufficient for removing a portion of sulfur and metal impurities from said feed stream and without substantially cracking said feed stream so as to provide an effluent having a reduced sulfur content;

(b) heating said reduced sulfur effluent under visbreaking conditions so as to lower the viscosity of said reduced sulfur effluent;

(c) thereafter contacting said reduced sulfur effluent with a solvent so as to form a mixture comprising at least two phases, wherein a first phase comprises an extract which is relatively lean in asphaltenes and metal content relative to said reduced sulfur effluent, and a second phase comprises a raffinate which is relatively rich in asphaltenes and metal content relative to said reduced sulfur effluent;

(d) separating said first phase and said second phase, and thereafter removing solvent from said first phase so as to provide an effluent stream essentially free of solvent;

(e) catalytically cracking said solvent free effluent stream, in the presence of a catalytic cracking catalyst and essentially in the absence of added hydrogen containing reactant gas so as to produce lower molecular weight hydrocarbon products.

11. A process in accordance with claim 10 wherein said heavy hydrocarbon feed stream comprises a heavy distillation residual fraction.

12. A process in accordance with claim 10 wherein said compounds of metal contaminants in said feed stream comprise compounds of at least one metal selected from the group consisting of nickel and vanadium and iron.

13. A process in accordance with claim 11 wherein said feed stream comprises about 3–500 ppmw nickel and about 5–1000 ppmw vanadium.

14. A process in accordance with claim 11, wherein said feed stream comprises about 0.5–5.0 weight percent sulfur.

15. A process in accordance with claim 10, wherein operating conditions in step (b) comprise a temperature in the range of from about 570° F. to about 630° F. for a period of time of from about 80 hours to about 120 hours.

16. A process in accordance with claim 1 wherein said hydrotreating catalyst additionally comprises:

a layer of hydrotreating catalyst having an average pore diameter in a range of from about 100 to about 500 angstroms placed above said hydrotreating catalyst having an average pore diameter in a range of from about 40 to about 80 angstroms recited in step (a) so as to form a mixed catalyst bed.

17. A process in accordance with claim 10 wherein said hydrotreating catalyst additionally comprises:

A layer of hydrotreating catalyst having an average pore diameter in a range of from about 100 to about 500 angstroms placed above said hydrotreating catalyst having an average pore diameter in a range of from about 40 to about 80 angstroms recited in step (a) so as to form a mixed catalyst bed.

18. A process in accordance with claim 1, wherein said hydrotreating catalyst comprises a catalyst bed containing a sole catalyst having an average pore diameter in a range of from about 40 to about 80 angstroms.

* * * * *

UNITED STATES PATENT AND TRADEMARK OFFICE

CERTIFICATE OF CORRECTION

PATENT NO. : 5,024,750

DATED : June 18, 1991

INVENTOR(S) : Edward L. Sughrue, II et al.

It is certified that error appears in the above-identified patent and that said Letters Patent is hereby corrected as shown below:

Column 12, line 1, please delete "VII" and insert therefor --- VIII ---.

Signed and Sealed this

Eighteenth Day of May, 1993

*Attest:*

Michael K. Kirk

MICHAEL K. KIRK

*Attesting Officer*

*Acting Commissioner of Patents and Trademarks*